US005954103A

United States Patent [19]

Smith

[11] Patent Number: 5,954,103

[45] Date of Patent: Sep. 21, 1999

[54] WATERTIGHT SUMP SHIELD ASSEMBLY FOR UNDERGROUND TANKS

[76] Inventor: Philip E. Smith, 2781 Rancho Rd., Redding, Calif. 96002

[21] Appl. No.: 08/939,474

[22] Filed: Sep. 22, 1997

[51] Int. Cl.[6] ..... B65B 1/04

[52] U.S. Cl. ..... 141/86; 137/312; 405/52

[58] Field of Search ..... 141/86, 311 A; 220/324, 323, 319, 315, 254, 378; 215/245, 274, 277, 284; 137/312, 314; 222/108, 111; 405/52

[56] References Cited

U.S. PATENT DOCUMENTS

| | | | |
|---|---|---|---|
| 4,659,251 | 4/1987 | Petter et al. | 141/86 |
| 4,696,330 | 9/1987 | Raudman et al. | 141/86 |
| 4,958,957 | 9/1990 | Berg et al. | 405/55 |
| 5,085,257 | 2/1992 | Smith | 141/86 |
| 5,114,271 | 5/1992 | Sunderhaus et al. | 141/86 |
| 5,271,518 | 12/1993 | Webb | 220/320 |

*Primary Examiner*—Henry J. Recla
*Assistant Examiner*—Timothy L. Maust
*Attorney, Agent, or Firm*—John P. O'Banion

[57] ABSTRACT

A sump shield assembly particularly adapted for creating a watertight seal with a container sump which are used with underground fluid storage tanks is disclosed. The assembly prevents water from entering a containment sump. This assembly includes a sump adapter, a sump shield and spill collector boots which couple to spill collectors that are commonly used to collect fluid spilled during the filling or evacuation of underground fluid storage tanks. The sump adapter is mounted to a containment sump, and includes a groove to receive a sealing member. The sump shield is shaped and configured to mate with the sump adapter and the gasket, and is secured to the sump adapter with releasable latches. The latches are used to make the shield easily removable, and also provide the clamping force needed to compress the gasket sufficiently to create a watertight seal. The spill collector boots join the spill collectors and the sump shield, and have watertight seals at both ends. Alternatively, a watertight sump lid is placed over the sump shield adapter and is secured to the sump adapter with releasable latches, thereby providing a watertight containment assembly. The watertight sump lid is used when no upward protrusions are required.

20 Claims, 5 Drawing Sheets

WATERTIGHT SUMP SHIELD ASSEMBLY FOR UNDERGROUND TANKS

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

This invention pertains generally to devices and methods for preventing fluids from leaking into the soil surrounding underground fluid holding tanks, and more particularly to a watertight sump shield assembly that prevents water from leaking into a containment sump associated with underground fuel tanks. Therefore, in the event that the fill pipes to the underground tank leak fuel into the containment sump, water will not mix with the fuel and create a hazardous waste.

2. Description of the Background Art

Prevention of soil and groundwater contamination is an important consideration in connection with underground tanks that are periodically emptied and refilled with toxic and/or flammable fluids. A source of potential contamination is a spill or leak from the tank "fill pipe" into the ground. As a result, underground tanks are typically fitted with a containment sump that collects fluids that have leaked from the fill pipe and prevents them from flowing into the surrounding soil. Sensors and alarms are also typically provided as an alert to such a condition.

A problem, however, is that existing spill collectors and sump covers do not provide a seal strong enough to prevent water from entering the containment sump. Therefore, entry of water into the containment sump is often erroneously sensed as a system leakage of a hazardous material. In addition, if water mixes with fuel that is present in the containment sump, a further hazardous condition will result. Accordingly, there is a need for a fuel storage tank containment sump shield assembly that provides a watertight seal which prevents water from entering the containment sump found on underground fuel tanks.

BRIEF SUMMARY OF THE INVENTION

The present invention generally pertains to a containment sump shield assembly capable of preventing water from entering into a containment sump associated with an underground storage tank.

By way of example, and not of limitation, the invention comprises a sump adapter, a sump shield, and spill collector boots that provide a watertight seal between a containment sump and spill collectors. The sump adapter is permanently mounted directly onto a containment sump which is attached to an underground tank. The adapter may alternatively be mounted to a sump reducer which is mounted to a containment sump. The sump shield is coupled to the adapter with releasable latches, and sealed with a gasket to provide a water tight seal with the adapter. The latches allow the sump shield to be removable and thereby provide access to the interior of the containment sump.

The sump shield may also include upward extensions which may have holes therein to provide for access to the containment sump or to be used in conjunction with spill collector boots coupled to spill collectors such as those taught in U.S. Pat. No. 4,696,330, incorporated by reference herein. The shield, adapter, gasket and boots may be constructed out of any material which can provide a barrier to water and/or petroleum products. A sump cover, such as that taught in U.S. Pat. No. 5,085,257, incorporated by reference herein, may be provided with downward extensions shaped and sized to mate with the spill collectors, thereby providing access to the filling or evacuation pipes housed by the spill collectors. By providing a watertight seal between the containment sump and the spill collectors by way of the sump shield, sump adapter and the spill collector boots, the intrusion of water into the containment sump is thereby eliminated.

A watertight containment sump lid may be used in lieu of a sump shield when there is no requirement for upward extensions. As with the sump shield configuration, the sump lid is coupled to the sump shield adapter with releasable latches and sealed with a gasket to provide a watertight seal with the sump shield adapter.

An object of the present invention is to provide a sump shield assembly that prevents water from entering a containment sump.

Another object of the present invention is to provide a watertight containment sump shield that is easily removed to access fill and evacuation pipes and to access and replace spill collectors that are coupled to the watertight sump shield.

Yet another object of the invention is to provide a watertight containment sump lid that is easily removed and can be used in place of a sump shield.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DETAILED DESCRIPTION OF THE INVENTION

Referring more specifically to the drawings, for illustrative purposes the present invention is embodied in the apparatus generally shown in FIG. 1 through FIG. 6. It will be appreciated that the apparatus may vary as to configuration and as to details of the parts without departing from the basic concepts as disclosed herein.

Figure 1:
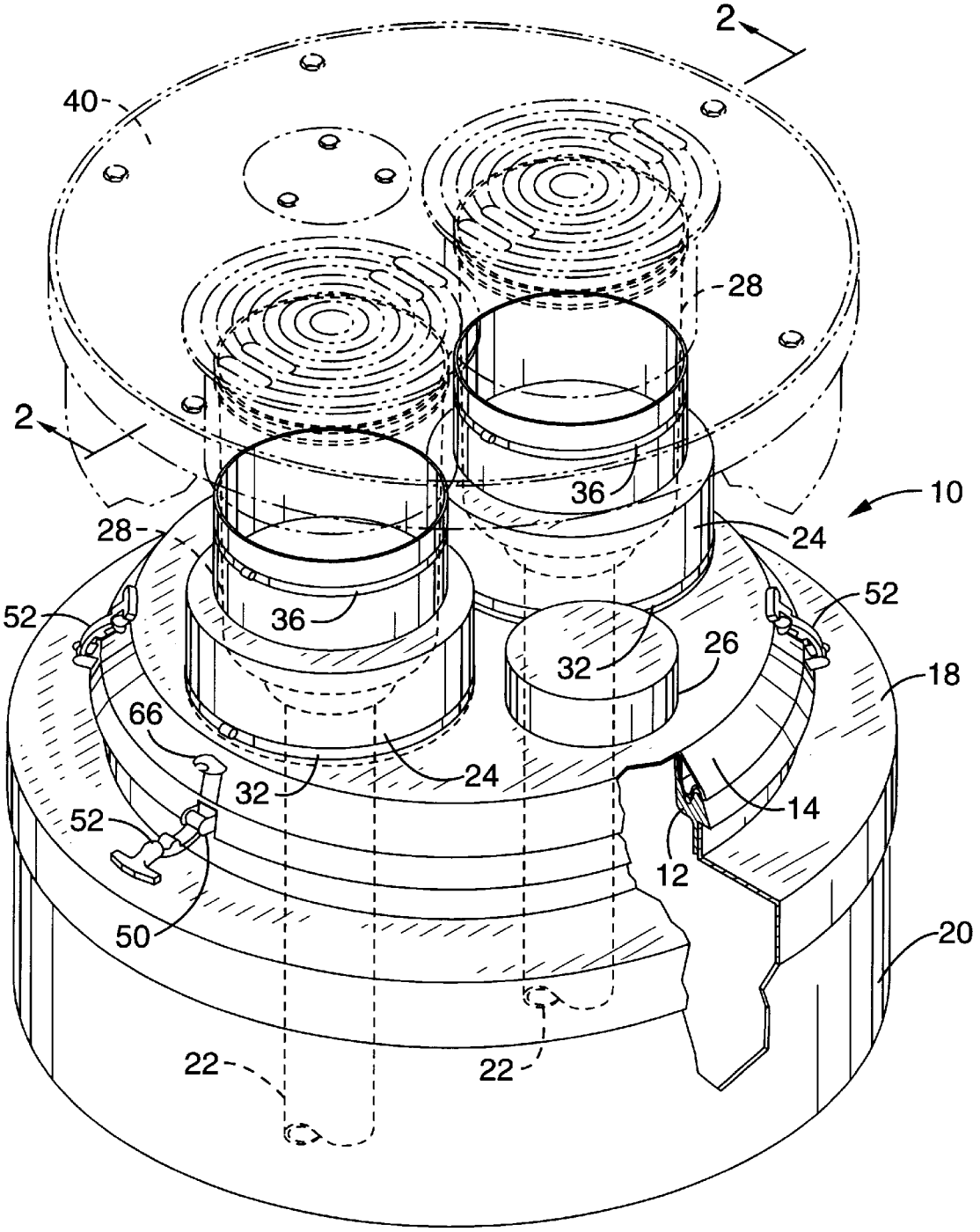
FIG. 1 is a perspective view of a watertight containment sump shield assembly in accordance with the present invention with a sump cover and a spill container shown in phantom.

Referring first to FIG. 1, a containment sump shield assembly 10 in accordance with the present invention is generally shown. Assembly 10 generally includes a sump adapter 12, a sump shield 14, spill collector boots 16, and may include a sump reducer 18. The containment sump body 20 is mounted to an underground fuel tank (not shown), and surrounds the fill or evacuation pipes 22 forming a reservoir as a means for catching any gasoline or other petroleum product that may leak from existing product piping and/or equipment. Sump reducer 18 has a lower end sized to fit over containment sump body 20 and is permanently mounted to the top edge of containment sump body 20. Sump adapter 12 is permanently bonded atop sump reducer 18. Sump shield 14 is shaped and configured to mate with sump adapter 12. The top surface of sump shield 14 may have one or more upward extensions, open 24 and closed 26, formed in it. The open upward extensions 24 mate with spill collector boots 16 which are mounted to the lower ends of spill collectors 28 such as those taught in U.S. Pat. No. 4,696,330, incorporated herein by reference.

Figure 2:
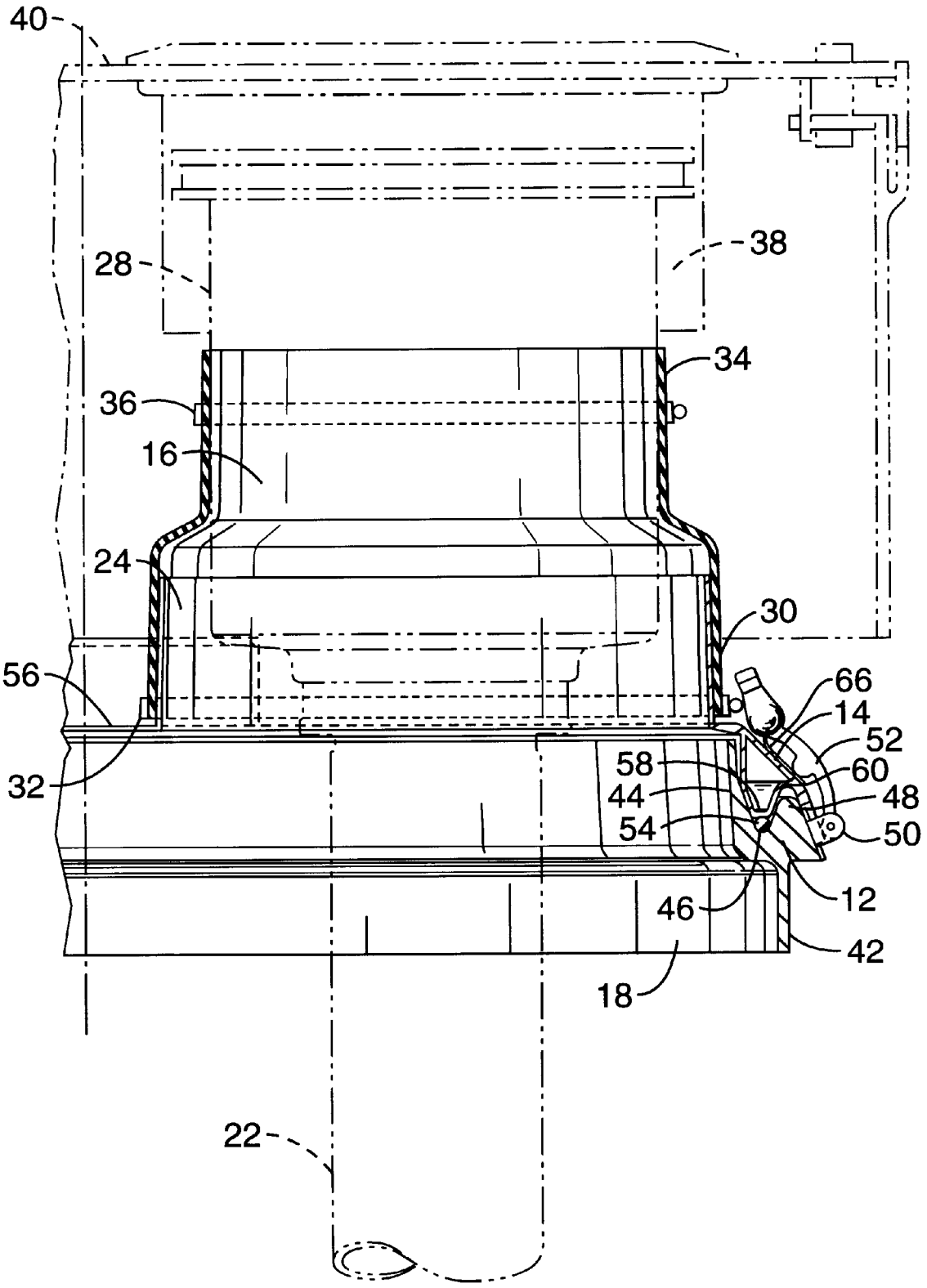
FIG. 2 is a partial cross-sectional view of the apparatus shown in FIG. 1 taken through line 2—2 and showing the right half of the assembly.

Referring also to FIG. 2, it can be seen that the lower end 30 of spill collector boot 16 has an inner diameter such that it fits snugly with the outer diameter of open upward extension 24. A sealing force is applied to the connection between spill collector boot 16 and open upward extension 24 to create a watertight seal therein by clamping device 32 such as a worm drive strap clamp or the like. Upper end 34 of boot 16 has an inner diameter such that it fits snugly with the outer diameter of spill collector 28. A sealing force is similarly provided at this junction by clamping device 36 such as a worm drive strap clamp or the like, to create a watertight seal between spill collector boot 16 and spill collector 28. The upper end of spill collector 28 is coupled to downward extending sleeves 38 of sump cover 40 as taught in U.S. Pat. No. 5,085,257, incorporated herein by reference.

Figure 3:
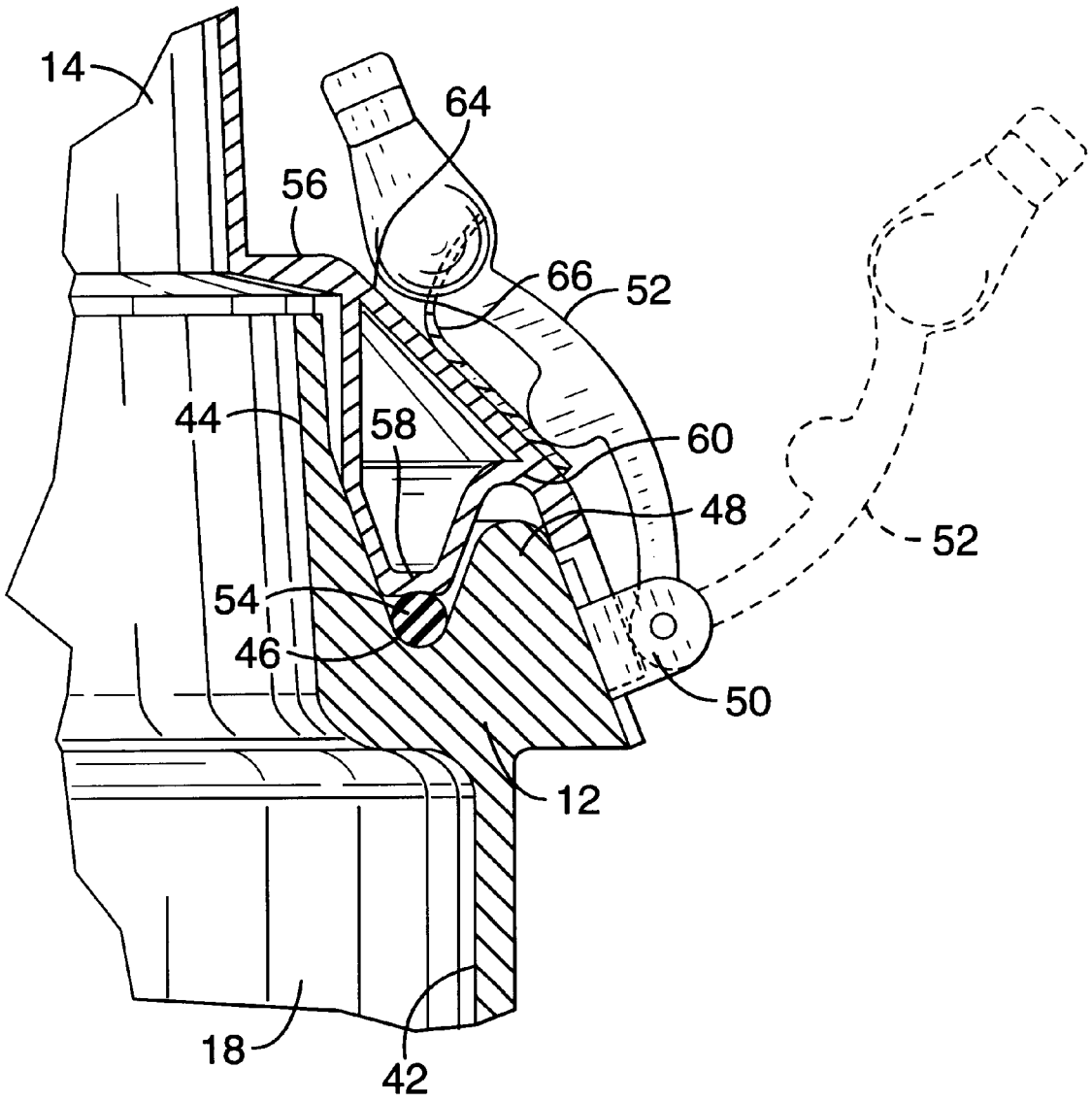
FIG. 3 is an enlarged fragmentary view of the coupling mechanism between the sump shield and sump adapter shown in FIG. 2.
Figure 4:
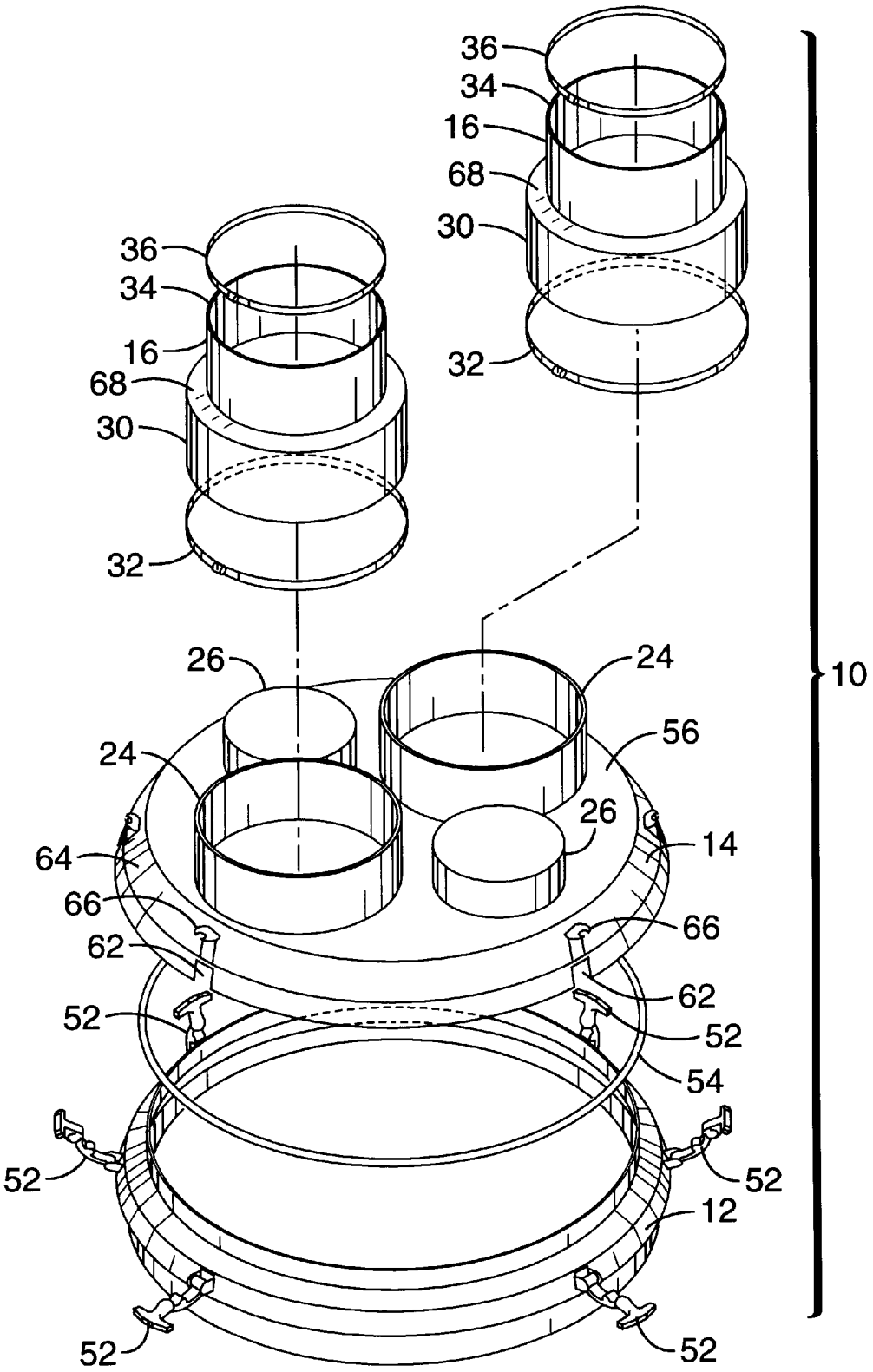
FIG. 4 is an exploded view of the apparatus shown in FIG. 1.

Referring also to FIG. 3 and FIG. 4, sump adapter 12 is preferably circular in shape and includes a lower annular wall 42, an upper annular wall 44, a sealing groove 46, and a coupling rail 48. Sealing groove 46 is formed between upper annular wall 44 and coupling rail 48. At least one draw latch hinge 50 is mounted to the outer surface of coupling rail 48. A draw latch member 52 is pivotally mounted to each draw latch hinge 50. Lower annular wall 42 is permanently bonded to sump reducer 18. A sealing element 54, which may be an O-ring gasket, sponge tape or other type of like gasket, lies in sealing groove 46.

Sump shield 14 is preferably circular in shape, and includes top wall 56, sealing ridge 58, coupling lip 60, notches 62, and coupling wall 64. Coupling lip 60 is preferably annular in shape, and configured to fit snugly with coupling rail 48. At least one draw latch hook 66 is mounted to coupling wall 64. Below each hook 66, a notch 62 is defined in coupling wall 64 to provide clearance for draw latch hinge 50 when shield 14 is mounted on adapter 12. Sealing ridge 58 is shaped to fit snugly within sealing groove 46 and with sealing element 54 such that when sump shield 14 is coupled to sump adapter 12, sealing element 54 lies between sealing ridge 58 and sealing groove 46. Draw latch hook 66, draw latch member 52, and draw latch hinge 50 are oriented such that when sump shield 14 is aligned with sump adapter 12, and draw latch member 52 is coupled with draw latch hook 66, draw latch member 52 produces sufficient coupling force to compress sealing element 54 between sealing ridge 58 and sealing groove 46 to produce a watertight seal. As can be seen in FIG. 4, top wall 56 of sump shield 14 may have one or more open upward extensions 24 or closed upward extensions 26. An open type of upward extension 24 is configured to mate with a spill collector boot 16. Spill collector boot 16 has a preferably cylindrical body 68, and includes a lower end 30 and an upper end 34 as previously described. With the sump adapter 12, sump shield 14, and spill collector boots 16 properly installed, leakage of ground water or other liquid into the containment sump is virtually eliminated.

Figure 5:
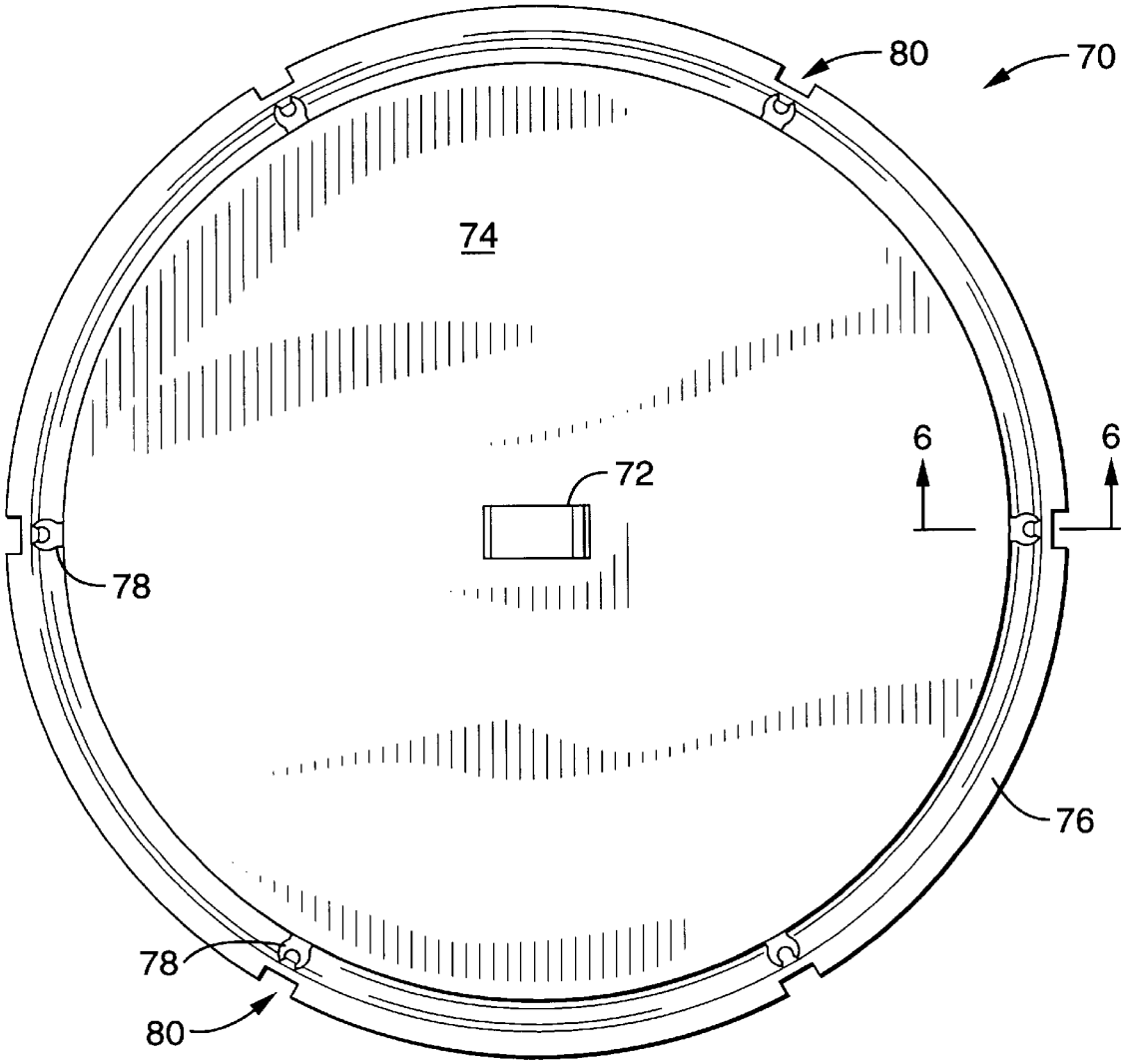
FIG. 5 is a top plan view of a watertight sump lid.

FIG. 5 shows a watertight sump lid 70, which is used as an alternative to sump shield 14 when no upward extensions are required. The watertight sump lid 70 is configured to fit over sump adapter 12. The watertight sump lid comprises a handle 72, a circular top wall 74, and a coupling wall 76 extending circumferentially from the top wall 74. A plurality of draw latch hooks 78 are provided around the circumference of the coupling wall 76, below which are notches 80 which provide clearance for draw latch hinge 50 when sump lid 70 is mounted on sump adapter 12.

Figure 6:
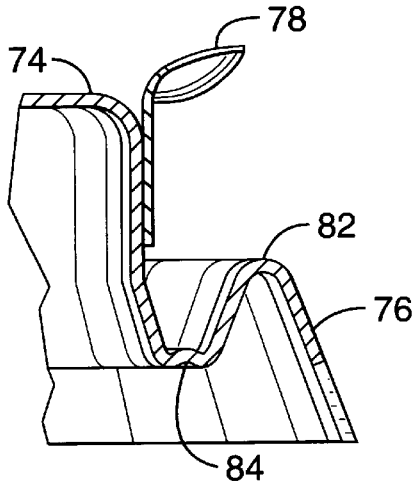
FIG. 6 is a partial cross-sectional view of the apparatus shown in FIG. 5 taken through line 6—6.

Referring to FIG. 6, a coupling lip 82 is disposed generally between top wall 74 and coupling wall 76 and a sealing ridge 84 is disposed generally between the top wall 74 and the coupling lip 82. The coupling lip 82 is preferably annular in shape and configured to fit snugly with coupling rail 48 of sump adapter 12. Sealing ridge 84 is shaped to fit snugly within sealing groove 46 and with sealing element 54 such that when the sump lid 70 is coupled to sump adapter 12, sealing element 54 lies between sealing ridge 84 and sealing groove 46, thereby providing a watertight seal. When the sump adapter 12 and the watertight sump lid 70 are properly installed, leakage of ground water or other liquid into the containment sump is virtually eliminated.

Although the description above contains many specificities, these should not be construed as limiting the scope of the invention but as merely providing illustrations of some of the presently preferred embodiments of this invention. Thus the scope of this invention should be determined by the appended claims and their legal equivalents.

What is claimed is:

1. A sump shield apparatus for providing a watertight seal in a containment sump assembly having at least one spill collector, comprising:

(a) a sump shield adapter capable of being rigidly fixed to said containment sump, said sump shield comprising
  (i) a continuous mounting member,
  (ii) said mounting member including an upper annular wall, a lower annular wall, and a coupling rail, and
  (iii) a sealing groove, said sealing groove disposed between said upper annular wall and said coupling rail;

(b) a sump shield, said sump shield shaped and configured to mate with said sump shield adapter; and (c) a spill collector boot, said spill collector boot including a lower end and an upper end, said lower end attached to said sump shield, said upper end capable of snugly fitting said spill collector.

2. An apparatus as recited in claim 1, further comprising:

(a) a sealing element;

(b) a sealing groove formed on said sump shield adapter, said sealing groove shaped and configured to receive said sealing element; and (c) a sealing ridge formed in said sump shield, said sealing ridge shaped and configured to fit snugly with said sealing element within said sealing groove.

3. An apparatus as recited in claim 1, further comprising a sump reducer, said sump reducer bonded to said lower annular wall of said sump shield adapter.

4. An apparatus as recited in claim 1, wherein said sump shield comprises:

(a) a circular top wall;

(b) an upward extension protruding from said top wall, said upward extension configured to snugly receive said lower end of said spill collector boot;

(c) a coupling wall, said coupling wall extending circumferentially from said top wall; and (d) a sealing ridge, said sealing ridge extending from said coupling wall, said sealing ridge shaped and configured to mate with said sealing groove of said sump shield adapter.

5. An apparatus as recited in claim 4, further comprising sealing means for creating a watertight seal between said spill collector boot and said spill collector and between said spill collector boot and said upward extension.

6. An apparatus as recited in claim 4, further comprising means for coupling said sump shield to said sump shield adapter.

7. An apparatus as recited in claim 6, wherein said coupling means comprises:

(a) at least one draw latch hinge mounted to said coupling rail of said sump shield adapter;

(b) a draw latch member pivotally mounted to said draw latch hinge; and (c) a draw latch hook mounted to said coupling wall of said sump shield, said draw latch hook capable of receiving said draw latch member whereby a compressive force is created when said draw latch member is coupled to said draw latch hook.

8. A sump shield apparatus for providing a watertight seal in a containment sump assembly having at least one spill collector, comprising:

(a) a sump shield adapter capable of being rigidly fixed to said containment sump, said adapter including an upper annular wall, a lower annular wall, a coupling rail and a sealing groove, said sealing groove disposed between said upper annular wall and said coupling rail;

(b) a sump shield, said sump shield including an upward extension, a coupling wall and a sealing ridge, said sealing ridge shaped and configured to mate with said sealing groove of said sump shield adapter;

(c) a spill collector boot, said spill collector boot including a lower end and an upper end, said lower end capable of snugly fitting said upward extension of said sump shield, said upper end capable of snugly fitting said spill collector; and (d) means for coupling said sump shield to said sump shield adapter.

9. An apparatus as recited in claim 8, further comprising a sealing element disposed between said sealing groove of said sump shield adapter and said sealing ridge of said sump shield whereby a watertight seal is formed when said sump shield adapter and said sump shield are coupled together.

10. An apparatus as recited in claim 8, further comprising sealing means for creating a watertight seal between said upper end of said spill collector boot and said spill collector and said lower end of said spill collector boot and said upward extension of said sump shield.

11. An apparatus as recited in claim 8, further comprising a sump reducer, said sump reducer bonded to said lower annular wall of said sump shield adapter.

12. An apparatus as recited in claim 8, wherein said coupling means comprises:

(a) at least one draw latch hinge mounted to said coupling rail of said sump shield adapter;

(b) a draw latch member pivotally mounted to said draw latch hinge; and (c) a draw latch hook mounted to said coupling wall of said sump shield, said draw latch hook capable of receiving said draw latch member whereby a compressive force is created when said draw latch member is coupled to said draw latch hook.

13. A sump shield apparatus for providing a watertight seal in a containment sump assembly having at least one spill collector, comprising:

(a) a sump shield adapter, said adapter mounted to said containment sump, said adapter including a coupling rail, an upper annular wall, and an annular groove, said groove disposed between said coupling rail and said upper annular wall, said groove shaped and configured to receive a sealing member;

(b) a sump shield, said shield including an annular ridge, said annular ridge shaped and configured to mate with said groove and said sealing member, said shield including a coupling wall shaped and configured to mate with said coupling rail, said shield including at least one tubular shaped upward extension;

(c) at least one spill collector boot, said boot tubular shaped, said boot having an upper end and a lower end, said lower end of said boot sized to receive said upward extension, said lower end of said boot clamped to said upward extension with a strap clamp;

(d) said upper end of said boot sized to receive a spill collector, said upper end of said boot clamped to said spill collector with a strap clamp; and (e) means to couple said sump shield and said sump shield adapter.

14. An apparatus as recited in claim 13, wherein said coupling means comprises:

(a) a plurality of draw latch hinges mounted to said coupling rail of said sump shield adapter;

(b) a plurality of draw latch members pivotally mounted to said draw latch hinges; and (c) a plurality of draw latch hooks mounted to said coupling wall of said sump shield, said draw latch hooks capable of receiving said draw latch members whereby a compressive force is created when each said draw latch member is coupled to each said draw latch hook.

15. An apparatus as recited in claim 13, further comprising a sump reducer, said sump reducer bonded to said lower annular wall of said sump shield adapter.

16. An apparatus as recited in claim 13, wherein said strap clamp on said lower end of said boot and said strap clamp on said upper end of said boot both provide watertight seals.

17. A sump lid apparatus for providing a watertight seal in a containment sump assembly, comprising:

(a) a sump shield adapter, said adapter mounted to said containment sump, said adapter including a coupling rail, an upper annular wall, a lower annular wall and an annular groove, said groove disposed between said coupling rail and said upper annular wall, said groove shaped and configured to receive a sealing member;

(b) a watertight sump lid, said sump lid including a sealing ridge, said sealing ridge shaped and configured to mate with said sealing groove and said sealing member, said sump lid including a coupling lip shaped and configured to mate with said coupling rail; and (c) means to couple said watertight sump lid and said sump shield adapter.

18. An apparatus as recited in claim 17, wherein said coupling means comprises:

(a) a plurality of draw latch hinges mounted to said coupling rail of said sump shield adapter;

(b) a plurality of draw latch members pivotally mounted to said draw latch hinges; and (c) a plurality of draw latch hooks mounted to said coupling wall of said watertight sump lid, said draw latch hooks capable of receiving said draw latch members whereby a compressive force is created when each said draw latch member is coupled to each said draw latch hook.

19. An apparatus as recited in claim 17, further comprising a sump reducer, said sump reducer bonded to said lower annular wall of said sump shield adapter.

20. A sump shield apparatus for providing a watertight seal in a containment sump assembly having at least one spill collector, comprising:

(a) a sump shield adapter, said sump shield adapter capable of being rigidly fixed to said containment sump;

(b) a sump shield, said sump shield shaped and configured to mate with said sump shield adapter;

(c) a spill collector boot, said spill collector boot including a lower end and an upper end, said lower end attached to said sump shield, said upper end capable of snugly fitting said spill collector;

(d) a sealing element;

(e) a sealing groove formed on said sump shield adapter, said sealing groove shaped and configured to receive said sealing element; and (f) a sealing ridge formed in said sump shield, said sealing ridge shaped and configured to fit snugly with said sealing element within said sealing groove.

* * * * *